United States Patent [19]

Kynast

[11] Patent Number: 4,463,985

[45] Date of Patent: Aug. 7, 1984

[54] HEEL STRAP RETRACTOR FOR WHEEL CHAIR FOOT RESTS

[76] Inventor: Lutz T. Kynast, 1221 W. Clarendon St., Arlington Heights, Ill. 60004

[21] Appl. No.: 454,986

[22] Filed: Jan. 3, 1983

[51] Int. Cl.[3] ..... A47C 7/50

[52] U.S. Cl. ..... 297/433; 297/423

[58] Field of Search ..... 297/433, 422, 436, 429

[56] References Cited

U.S. PATENT DOCUMENTS

| | | | |
|---|---|---|---|
| 2,841,208 | 7/1958 | Duke | 297/433 |
| 3,790,212 | 2/1974 | Suyetani | 297/433 |
| 3,990,744 | 11/1976 | Rodaway | 297/433 |
| 4,243,265 | 1/1981 | Hanik | 297/433 |

OTHER PUBLICATIONS

Everest & Jennings, Inc., The Wheelchair Catalog, Sep. 1980, pp. 1-9, 12, 60, 61 and 64.

*Primary Examiner*—Francis K. Zugel

*Attorney, Agent, or Firm*—McWilliams, Mann, Zummer and Sweeney

[57] ABSTRACT

A heel strap retractor for wheel chair foot rests, in which the familiar foot rest support platform of each of the wheel chair foot rests is equipped with the retractor that comprises a resiliently flexible spring filament device of one piece spring wire construction formed to define a helically contoured annular socket portion that receives the upright pendantly mounted portion of the foot rest support, for seating of the retractor at the level of the foot rest heel strap; the device below the retractor socket portion is shaped to anchor the retractor to the foot rest support by a snap fit connection, and the device adjacent the top of the socket portion is shaped to define a finger projecting radially of the retractor socket portion that is angularly related with respect to the helix axis thereof and proportioned lengthwise thereof so that when the finger is placed in engagement with the rear side of the foot rest heel support, the retractor socket portion is partially wound up to spring bias the finger against the strap from the rear side of same. When the foot rest is moved to its retracted position from its extended position, its heel strap is automatically retracted forwardly of the foot rest to avoid interference with full retraction of the foot rest. When each foot rest of the wheel chair is so equipped, the patient on entering and leaving the chair need not be concerned about having to manipulate the heel strap to have full unimpeded access to and from the chair.

5 Claims, 12 Drawing Figures

HEEL STRAP RETRACTOR FOR WHEEL CHAIR FOOT RESTS

This invention relates to a heel strap retractor for wheel chair foot rests, and more particularly to a device for automatically retracting the heel strap forwardly of its heel holding position as the foot rest to which it is applied is swung from its extended foot rest position to its retracted out of the way position, for insuring repositioning of the heel strap so that full retraction of the foot rest to which it is applied is readily effected.

Wheel chairs are commonly used for seating and moving about persons who, for reasons of being ill, infirm, handicapped, or whatever, are unable to stand-/or walk normally, or otherwise require wheel chair use. Wheel chairs are familiar equipment of hospitals, nursing homes, retirement facilities, and the like, as well as private homes where a family member is ill or infirm and needs something more than the familiar walker to get or be moved about.

Conventional wheel chairs commonly are equipped with a separate generally flat foot rest or tread member for each foot of the person using the chair (hereinafter generically called "the patient" for convenience of reference). The foot rest members of the wheel chair are at the front of the chair, with each foot rest member being mounted on its own support that is pendantly, and usually adjustably, mounted on the wheel chair frame, just in front of, below and toward either side of the wheel chair seat. The foot rest support for each foot rest member commonly is of right angled configuration defining an upright or post portion that is suitably connected to the chair frame (usually by the common adjustable wedge assembly), and a forwardly projecting arm at the lower end of the upright portion on which the foot rest member supported by the foot rest support in question is mounted for swinging movement between an extended foot rest defining position across the front of the wheel chair, and a retracted upright vacant position against or adjacent the support of the foot rest in question, so as to open up the front of the wheel chair to permit the patient to have ready access to and from the chair and to permit folding of the chair for storage where the chair is of the folding type. The foot rest or tread members of the chair commonly are generally flat in configuration and are disposed in coplanar or near coplanar relation in their extended foot rest defining positions, and are mounted to swing in opposite directions when moved to their retracted positions. Each foot rest member is commonly equipped with a heel strap on the top or foot tread side of the foot rest member, which strap may be formed from canvas, plastic, leather or other strapping forming flexible material. The strap is applied across the rear of each foot rest member and against the upper or tread side of the foot rest member by having the ends of the strapping involved anchored to the foot rest member forwardly of the foot rest support and adjacent to either side edge of the foot rest member in question, to dispose the length of the heel strap between its said ends, along a side edge of same, in close adjacency to the foot rest upper or tread forming surface for receiving the heel of the patient's foot that is to rest on the foot rest member in question, with the heel strap taking a catenary fashion shaping rearwardly of the foot rest member when being so used.

The wheel chair foot rests in question serve the very useful purpose of keeping the patient's feet off the floor to avoid dragging same or the patient having to lift same when the chair is moved, and also to place the feet at a level relative to the chair seat for normal sitting comfort. This further permits the patient to be readily moved by moving the chair when desired. As indicated, the foot rest members in question are adjustable vertically for comfortable accommodation of the patient's feet thereon, and the heel straps serve to keep the patient's feet from shifting undesirably rearwardly of the chair foot rests and also serve as rests against which the patient's heels engage to comfortably accommodate the patient's feet on the respective foot rest members of the chair. These purposes are served regardless of whether or not the patient has shoes or slippers on, though for adequately comfortable dressing the patient using the chair usually has shoes or at least slippers on, and these are what engage the heel straps.

When the patient is to either enter or leave the chair, the chair foot rest members in question must be tilted or swung out of the way, and thus to their retracted generally upright positions on either side of the chair front. If the heel straps of the individual foot rest members are not shifted forwardly, from their rearwardly curving catenary defining positions when used by the patient sitting in the chair, before retracting the foot rest members the rest members may only partially retract, due to the interference of the heel straps with the respective foot rest member supports. Thus, the foot rest members, instead of being fully out of the way, will remain positioned partially in front of the chair seat sufficiently to interfere with the patient's efforts to enter or leave the chair, and thereby impair the safety of the patient in both the leaving and entering of the chair. Further, in wheel chair arrangements devised to fold flat for storage purposes, folding of the chair for storage is impeded for the same reasons.

However, the Applicant's experience has shown that patients commonly do not manipulate the heel straps as needed to achieve the full raising of the foot rest members to their retracted positions that is needed for the patient to safely and readily enter or leave the chair without stumbling or other impedance caused by partially retracted foot rests. The reasons for this are numerous, as the patient may be too ill or of too impaired functional condition to manipulate the heel straps, or the patient may lack understanding or mechanical ability to perform the needed function, etc. In any event, the result is that either the patient has to be assisted in this regard, or the patient's access to and from the chair is impaired, safety reduced, and accident prone.

A principal object of the present invention is to provide, for each wheel chair foot rest member, a heel strap retractor that permits the heel strap to be used in its normal manner when the patient is sitting in the chair, but which effects automatic retraction or repositioning of the heel strap when the foot rest member is tilted or swung to its retracted position, so that full swinging of the foot rest member in question to its retracted position is achieved without the patient or the person assisting him having to be concerned about it.

Another principal object of the invention is to provide a heel strap retractor for wheel chair foot rests that is of one piece construction and that fits the types of wheel chair foot rest assemblies that are commonly equipped with the indicated heel straps, and that is economical of manufacture, easy to apply, and reliable in use.

In accordance with the present invention, a heel strap retractor for wheel chair foot rests is provided in which the familiar foot rest support of each foot rest of the chair is equipped with the retractor of the invention that comprises a resiliently flexible spring wire filament device of one piece spring wire construction formed to define a helically contoured wind up socket portion of anular shaping that receives the upright pendantly mounted post portion of the foot rest support, for seating of the retractor at the level of the heel strap of the foot rest applied to the foot rest support in question; the retractor device below the retractor socket portion is shaped to anchor to the foot rest support by a snap-fit connection, and the spring adjacent the top of the socket portion is shaped to define a finger projecting radially of the socket portion that is annularly related thereto with respect to the helix axis thereof and proportioned lengthwise thereof so that when the finger is placed in engagement with the rear side of the heel strap, the retractor socket portion is partially wound up helical spring style to spring bias the finger against the strap. When the foot rest in question is moved to its retracted position, the length of its heel strap between the anchored end portions of the heel strap is automatically thrust forwardly to a position by the camming action of the retractor finger on the heel strap, which positions the heel strap to permit full movement of the foot rest to its retracted position without anyone having to manipulate the heel strap to achieve this.

For each wheel chair equipped with the indicated foot rests having the heel straps, a retractor of the invention is applied to each foot rest assembly in the manner indicated, with the retractor being arranged so that it can be applied to the foot rest assembly without making any structural changes in the wheel chair, or having to drill holes or otherwise shape or change the existing structure. The retractor of the invention is arranged for slip on, snap fit application to the individual foot rest support assemblies in a manner that insures the retractor will remain securely in place for the life of the equipment involved, and act automatically to retract the heel straps whenever the foot rests are swung to their inoperative positions.

Other objects, uses, and advantages will be apparent or become obvious from a consideration of the following detailed description and the application drawings in which like reference numerals indicate like parts throughout the several views.

In the drawings:

FIG. 1 is a diagrammatic perspective view illustrating a commercially available type of wheel chair having its foot rests both equipped with the heel strap retractor of the present invention;

FIG. 2 a fragmental perspective view on an enlarged scale of the foot rest assembly on the patient's right hand side of the wheel chair of FIG. 1, as equipped with the heel retractor of the present invention;

However, it is to be distinctly understood that the specific drawing illustrations provided are supplied primarily to comply with the requirements of the Patent Laws, and that the invention is susceptible of other embodiments and modifications that will be obvious to those skilled in the art, and that are intended to be covered by the appended claims.

Figure 1:
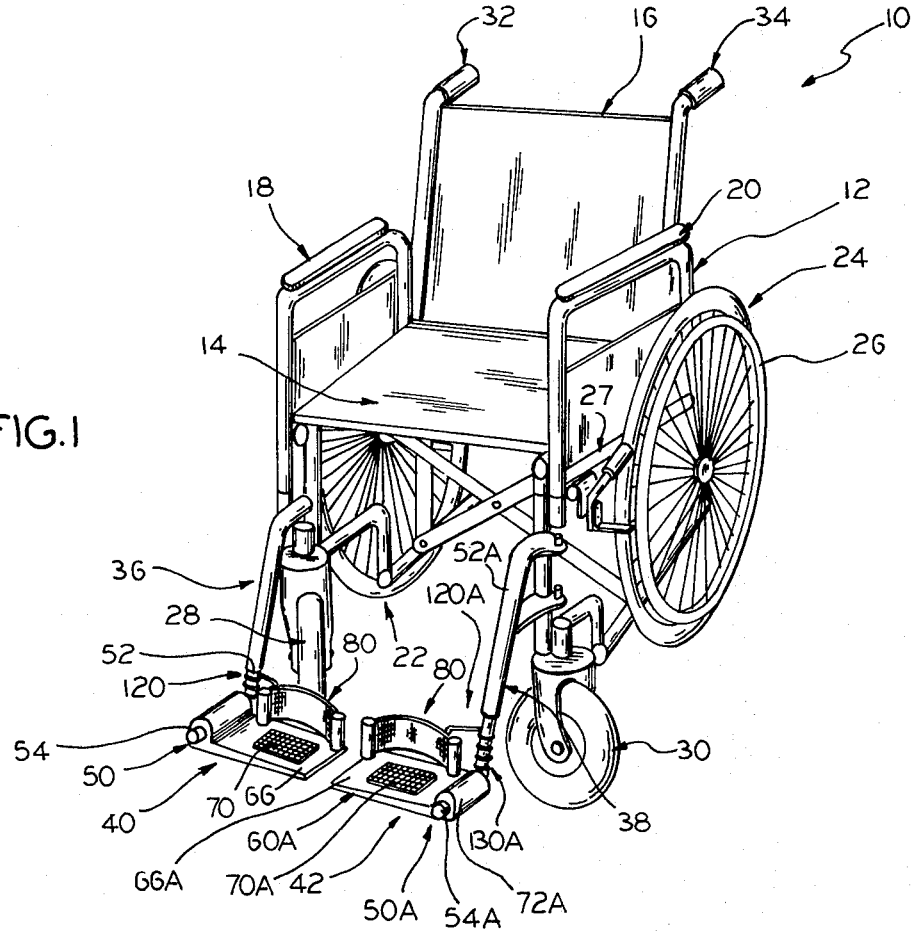

Reference numeral 10 of FIG. 1 generally indicates a diagrammatically illustrated wheel chair of the type commercially available as, for instance, from Everest & Jennings Inc. of Los Angeles, Calif. Such chairs are commonly used by persons that are in an invalid condition for one reason or another, as, for instance, due to a disease or sickness, advanced age, etc. Equipment of this type is commonly used in hospitals, nursing home facilities, retirement homes, and the like, and generally comprises the usual chair frame 12 and associated parts that define in any suitable manner the chair seat 14, the chair back 16, and the chair side arms 18 and 20 on either side of the seat 14. The frame 12 is equipped with the usual large diameter rear supporting wheels 22 and 24 on either side of same, each of which is equipped with the familiar circular handle 26 for enabling the occupier of the chair 10 to, by hand, move or adjust the position of the chair 10. Suitable brake devices 27 are commonly provided as is conventional.

The chair 10 is equipped with the usual familiar front caster wheels 28 and 30 at the forward or front side of the chair, and with the familiar rearwardly projecting handles 32 and 34 on the back of the chair for enabling the chair to be moved by an individual positioned at the rear of a chair, such as a nurse's aid or the like, as is well known to the art. The chair 10 illustrated is of the foldable type, and the specifics of the folding arrangement involved are well known to the art, which ordinarily involves the frame 12 being formed to fold or collapse flat (from either side thereof) in one of the various ways such frames are constructed for this purpose, as illustrated by the folding wheel chairs marketed by Everest & Jennings Inc.

The chair frame 12 at the forward or front end of the chair is typically equipped with downwardly directed tubular mounting struts 36 and 38 each of which supports one of the foot rest assemblies that are illustrated in FIG. 1, the foot rest assembly 40 being supported by strut 36, while the foot rest assembly 42 is supported by the strut 38.

The respective foot rest assemblies are connected to the respective struts 36 and 38, which commonly are tubular in nature, by way of a conventional wedge adjustment assembly device that suspends the respective foot rest assemblies 40 and 42 in their operative positions, and permits adjustment of same vertically to achieve their alignment horizontally, as indicated in FIG. 1, and to vertically position the foot rests for the comfort of the patient to occupy the chair, which will depend on such factors as the length of the patient's legs, and the position which the patient's legs and feet are to be supported when the patient uses the chair, etc.

The foot rest assemblies 40 and 42 are typically provided in matched pairs and are identical, except for the familiar mirror image relationship whereby they are provided in matched pairs for application to wheel chairs, one on either side of the front of the chair, such as wheel chair 10.

In the showing of FIGS. 2–5, 9 and 10, while only the foot rest assembly 40 is illustrated, it will be understood that the foot rest assembly 42 is similarly arranged in the usual left hand versus right hand operation mirror image reversal of parts manner as will be quite apparent by those skilled in the art.

Consequently the detailed description of the foot rest assembly 40 and the application of the invention of this application thereto that follows will be fully applicable to the foot rest assembly 42, it being understood that the foot rest assemblies 40 and 42 are oppositely operative in the usual right hand and left hand manner for this type of device. Thus, the reference numerals applied to the foot rest assembly 42 that bear the letter A are the same as the corresponding reference numerals applied to foot rest assembly 40 with the exception that foot rest assembly 42 and associated components are arranged for application to the left hand side of the chair 10, as distinguished from the right hand side application of the foot rest assembly 40 and its associated components.

Foot rest assembly 40 generally comprises a support member 50 of generally right angled configuration defining an upright connecting post portion 52 that is applied to the strut 36 in the aforementioned manner for securement and adjustment purposes. The member 50 further comprises forwardly projecting arm 54 that is suitably anchored to the lower end 56 of upright portion 52, as by welding at 58 (see FIGS. 9 and 10). Post portion 52 and arm 54 are typically formed from chrome plated steel tubing, but of course other metal and/or plastic materials of adequate strength, etc. characteristics may be employed.

Journalled on the arm 54 for swinging movement thereabout is foot rest member 60 which conventionally comprises plate member 62 defining generally flat foot tread or rest portion 64 defining upper surfacing 66 and lower surfacing 68. The upper surfacing 66 is recessed for application thereto of the familiar tread pad 70 that is formed from a suitable plastic or rubber or rubberlike material and is fixed in place in any suitable manner known to the art, such as by integral beads 71 that are forced through correspondingly located apertures 73 formed in member 60. The undersurfacing 68 is suitably ribbed and the like as needed for reinforcement and other engineering purposes.

Plate 62 also defines bearing housing portion 72 in which the support arm 54 is journalled, in any conventional manner, as by employing suitable sleeve type plain bearings 73 and 75 that are suitably mounted in the housing 72 (see FIG. 3), in which arm 54 is frictionally journalled, so that the foot rest member 60 is not free swinging relative to its support member 50, but rather swings readily relative to the member 50 when moved by hand, but when released, the foot rest member 60 remains in the position released due to the frictional gripping relationships of the journalling bearings 73 and 75 on arm 54, all as is well known in the art. The outwardly projecting end 76 of arm 54 is conventionally finished off with a suitable plug 77, formed from a suitable elastomeric material, and held in place by suitable screw 79.

Figure 2:
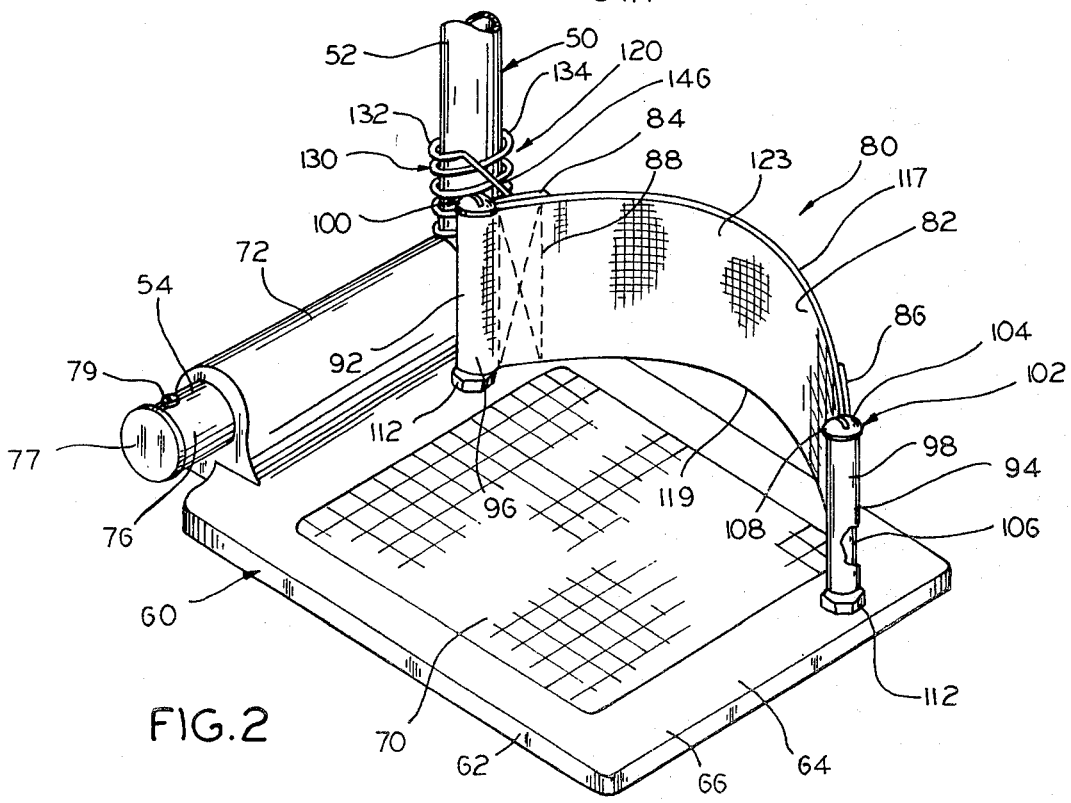
Figure 3:
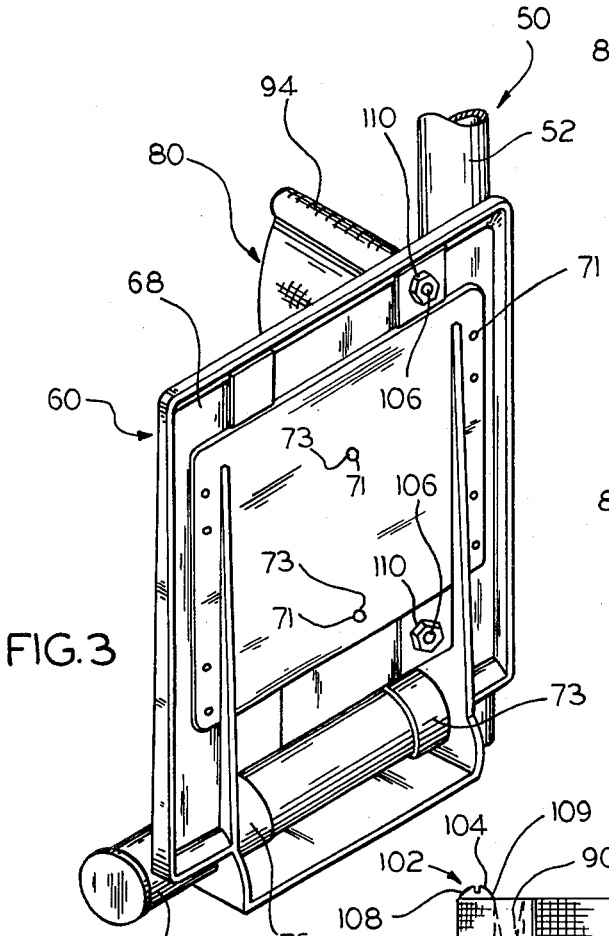
FIG. 3 is similar to FIG. 2, but shows the foot rest in question in its retracted or upright position.
Figure 12:
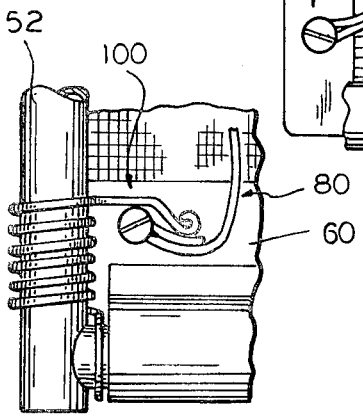
FIG. 12 shows the foot rest assembly of FIGS. 3 and 10 with the retractor as disposed in the fully retracted position of the assembly.

In the particular arrangement illustrated, the lower end 56 of the foot rest support upright post portion 52 extends downwardly sufficiently so that the side edge 74 of the foot tread member 60 that is located adjacent the bearing housing portion 72 engages said support member end 56, as a stop arrangement, which disposes foot tread member 60 in the substantially horizontal, extended position indicated in FIGS. 1 and 2; when a patient sitting in the chair 10 is to place his feet, or have his feet placed, on the respective foot tread members 60 and 60A. This is the extended position of the foot rest members 60 and 60A, while the retracted position of same is indicated by the showings of FIGS. 3 and 12, in which the foot rest members 30 and 60A are swung upwardly to the substantially upright or vertical position, and perhaps even into abutting relation with the foot rest support member post portion 52. In this relation of the foot tread members 60 and 60A, the foot tread members are out of the way so that the patient can have ready and unimpeaded access to and from the chair 10.

It has become frequent practice to apply to the respective foot rest members 60 and 60A heel straps 80 in the more better equipped chairs 10, and as needed by the patient's condition, by prescription. In the form shown the heel straps 80 each comprise a strip of canvas webbing 82 having its respective ends 84 and 86 turned over against the strapping and stitched as at 88 and 90 so that at the ends 92 and 94 of the strap 80 closed strapping loops 96 and 98 are defined. The heel straps 80 are applied to the respective foot tread members 60 and 60A by applying the respective screw and nut type fasteners 100 and 102 through the respective strapping loops 96 and 98 and appropriate holes formed in the respective members 60 and 60A to mount the straps 80 in their desired rearwardly disposed positions on the respective foot rest members 60 and 60A. The screw and nut type fasteners 100 and 102 each comprise a screw 104 with an elongate shank 106 and a head 108 with the arrangement being such that the slotted screw head 108 bears against the upper ends 109 of the respective loops 96 and 98 and the shank 106 extends through appropriate holes formed in the members 60 and 60A for application thereto of fastening nuts 110 (see FIG. 3). On the upper surfacing 64 of the members 60 and 60A suitable clamping nuts 112 are also applied to the respective screw shanks 106 to firmly anchor these devices in their secured positions indicated in the drawings, and draw the lower ends 111 of the respective strap loops against nuts 112, in one convenient way of mounting straps 80.

Figure 5:
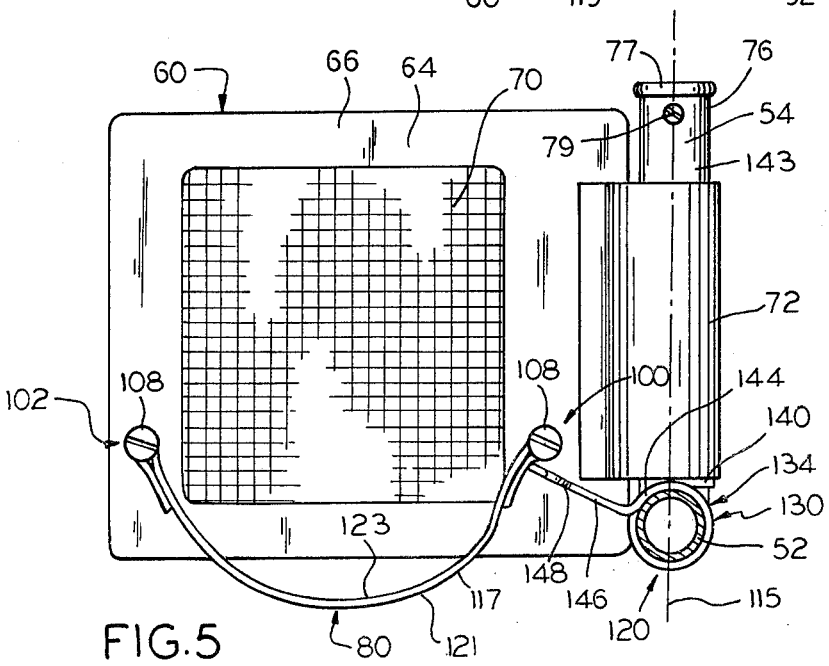
FIG. 5 is a top plan view of the foot rest assembly shown in FIGS. 2 and 4.

The screw and nut type devices 100 and 102 are applied along the rear of the respective members 60 and 60A and are spaced apart so that the length 116 of the strap between the respective devices 100 and 102 will arch in a catenary configuration rearwardly of the respective foot rest member 60 and 60A to serve as convenient rests for the heels of the patient sitting in the chair 10, when the patient's feet are resting on the respective foot rest member 60 and 60A. Devices 100 and 102 are applied forwardly of the foot rest member support upright portion 52, with the device 100 being adjacent the support member upright portion 52 and devices 100 and 102 being aligned crosswise of the respective members 60 and 60A in a plane that extends normally of the axis 115 of rotation for swinging movement of the respective members 60 and 60A relative to support member 50. As indicated in FIG. 5, the straps 80 in their heel receiving catenary like shaping relation extend rearwardly of the upright portion 52 of the respective supports 50, and straps 80 are mounted with their lower edgings 119 in close adjacency to foot rest surface 66 and their upper edgings 117 oppositely disposed. While the straps 80 are illustrated as being formed from canvas webbing, other strap forming material may also be employed, such as leather, plastic ribbons, or the like, as is known to the art, with end loops corresponding to strapping loops 96 and 98 being formed in any suitable manner.

As has been brought out hereinbefore, it is of fundamental importance for the safety of the patient moving into and out of the chair 10 that the foot rest members 60 and 60A be swung to their fully retracted positions illustrated in FIG. 3 so that they are in substantial upright position, for giving the patient unobstructed movement access to and from the chair. This is also important for folding type wheel chairs in order to achieve the full flattened condition of the chair for storage purposes.

However, experience has shown that patients and their aid attending them have considerable difficulties in achieving the full retracted position of the respective foot members 60 and 60A due to the fact that the heel straps 80 remain in the position of FIG. 5 when the respective foot rest members 60 and 60A are swung upwardly toward the retracted position of FIG. 3, with the result that the upper edging 117 of the heel strap engages against the upright portion 52 of support member 50, which tends to leave the foot rest members 60 and 60A on the order of 20 to 30 degrees short of their desired upright positioning of FIG. 3. This leaves the foot rest members 60 and 60A in upwardly converging inwardly projecting relation which thus form undesirable obstructions to the patient trying to enter or leave the chair 10. This undesirable upwardly converging positioning of the foot rest members 60 and 60A in their near retracted positions is generally considered to pretty much adversely affect the safety of the transfer intended by the individual either entering or leaving the chair 10.

Figure 11:
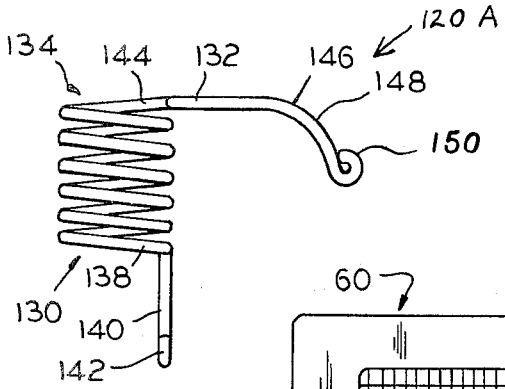
FIG. 11 is a view similar to that of FIG. 8, but shows instead the left hand retractor of the left hand foot rest assembly of FIG. 1.
Figure 9:
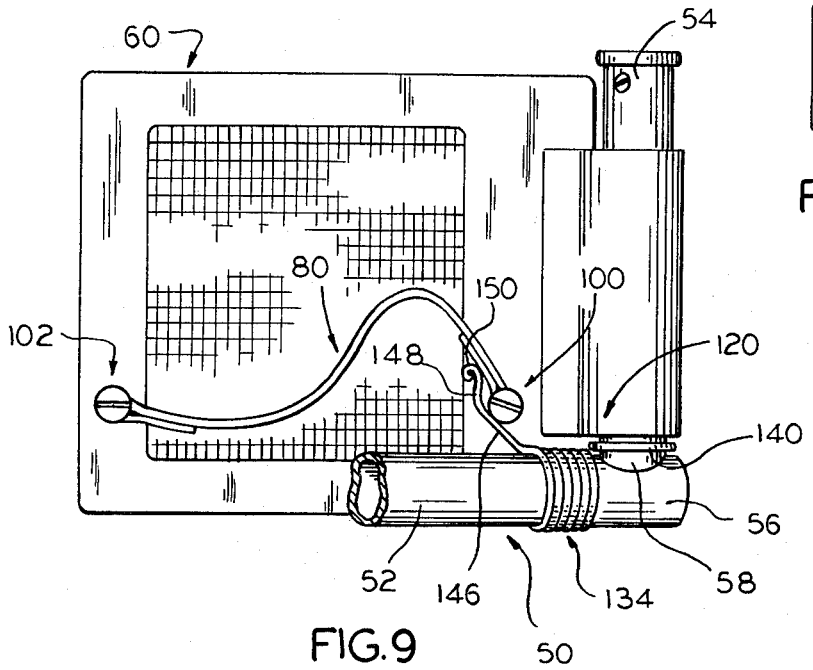
FIGS. 9 and 10 are similar to FIG. 5, but indicate the action of the retractor on the heel strap when there is relative movement of the foot rest with respect to its support in the action of moving the foot rest from the extended operative position shown in FIG. 2 toward the retracted upright position of FIG. 3.
Figure 10:
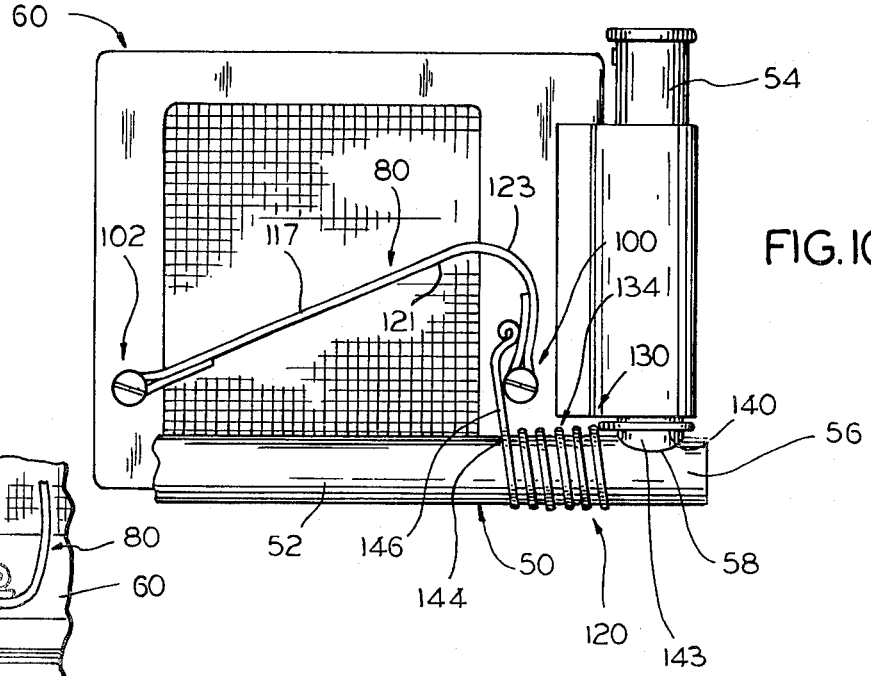

The present invention is directed to effecting automatic retraction of the heel straps 80 from their heel receiving position of FIGS. 1, 2 and 5 to the forwardly retracted position of FIG. 10, and for this purpose foot rest assembly 40 is provided with heel strap retractor 120 and foot rest assembly 42A is provided with heel strap retractor 120A. The heel strap retractors 120 and 120A are of identical design, but are arranged for application to the right hand and left hand foot rest assemblies 40 and 42, respectively, and thus are of mirror image configuration. The retractor 120 is shown in detail in the showings of FIGS. 2–10, while the retractor 120A (see FIGS. 1 and 11) is similarly arranged, with the only difference being that it is applied in a left hand manner to the left hand foot rest assembly 42, as compared to the right handed manner of arrangement application of the retractor 120 and its application to foot rest assembly 40.

Figure 6:
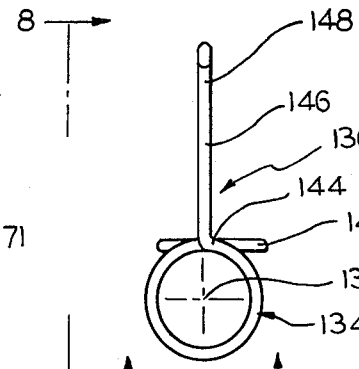
FIG. 6 is a top plan view of the retractor free of application to the foot rest assembly, and in its unstressed relation.
Figure 7:
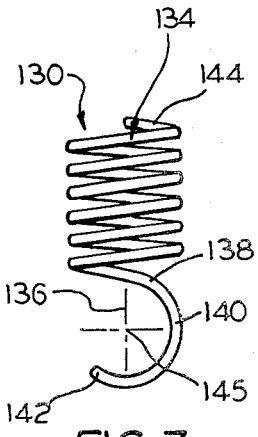
FIG. 7 is an elevational view of the retractor, taken along line 7—7 of FIG. 6.
Figure 8:
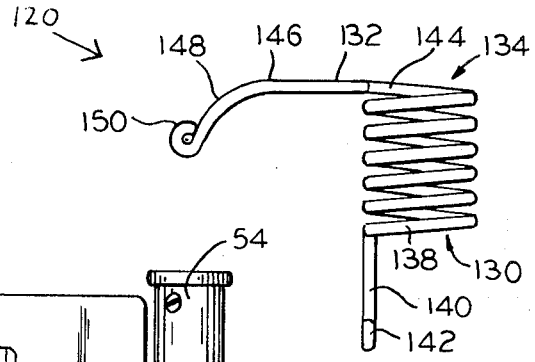
FIG. 8 is a side elevational view of the retractor, taken substantially along the line 8—8 of FIG. 6.

FIGS. 6, 7 and 8 show the retractor 120 in its unassembled relation, and as illustrated it will be seen that it comprises a resiliently flexible spring filament, clip or inter-connecting device 130, formed from a length of stainless steel wire of a suitable size and temper, such as stainless steel wire 18-8 type 302, having a diameter of 0.100 inch. The device 130 comprises a helically contoured spring wire wind up socket portion 134, which is defined by the wire 132 being helically wound about the central axis 136. The socket portion 134 at its lower end 138 merges into open loop portion 140 where the terminal portion 142 of the wire is spaced sufficiently from the socket portion 134 so as to have snap fit relation with the foot rest assembly support arm 54, and specifically its external diameter surfacing 143, as will be described hereinafter.

The device 130 at the upper end 144 of the socket portion 134 is shaped to define a finger 146 that is in coil spring torsion wind up relation to the device socket portion 134 for providing the spring bias against the heel strap that is contemplated by the present invention.

As illustrated in FIG. 6, the finger 146 is formed to lie in a plane that includes the central axis 136 of the socket portion 134, whereby the finger 146 extends radially of the socket portion 134. As also indicated in FIG. 6, the plane in which the finger 146 lies is substantially perpendicular to the plane of open loop 140, which is in substantial tangency with the device socket portion 134 on the side of same from which the finger 146 projects.

As shown in FIG. 8, finger 146 is formed to define a projecting camming end 148 that is arcuate in configuration, and in the plane that includes the finger 146 and axis 136. The camming end 148 terminates in a curled over terminal portion 150 that is convexly shaped about its external surfacing for smooth camming characteristics free of penetration or snagging with the heel strap that it is to cooperate with.

The device 130 in the right hand form 120 that is shown in FIGS. 6–8 is adapted for application to the foot rest assembly 40 without any modification of the foot rest assembly whatsoever, and requires no drilling of holes or otherwise deforming of the foot rest assembly of parts that are involved, or securing adhesive, or the like.

For application of a right hand device 130 to complete a foot plate assembly 40, the foot plate assembly 40 may be assembled in a normal manner to operably mount the foot plate member 60 and its heel strap 80 on the support 50 in the conventional manner that has been described.

With the support 50 of assembly 40 still disassembled from the strut 36, the device 130 that is to be employed to complete the foot rest assembly 40 is positioned to receive the support upright post portion 52 within its socket portion 134, with the open loop 140 disposed downwardly. The device 130 is slipped downwardly of the support upright portion 52 to the position approximating that shown in FIG. 4, and the device 130 is maneuvered to dispose the open loop 140 on the side of the support upright portion 52 on which the arm 54 projects so that the arm 54 may be snapped past the lower end 142 of the wire 132 to snap fit seat the open loop 140 on the arm 54, across its external surfacing 143.

Figure 4:
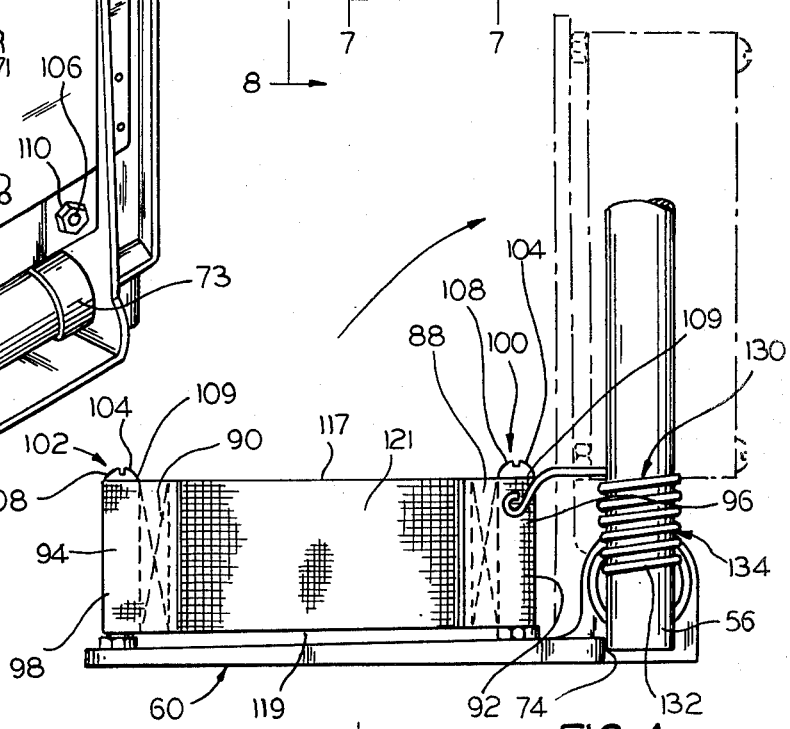
FIG. 4 is a rear elevational view of the foot rest assembly shown in FIG. 2, with the foot rest shown in its retracted position in phantom.

The finger 146 is then lifted upwardly and swung counterclockwise of the showing of FIG. 5 to the position of FIG. 5, to the rear of the screw and nut type fastening device 100 and disposed in engagement with the strap pocket 96 secured thereby, and specifically in contact with the rearwardly facing side 121 of same, as suggested by the showing of FIGS. 4 and 5, as distinguished from the forward facing side 123 of same.

The left hand retractor foot 20A, as already indicated, is arranged similarly to the device 130, but the spring winding process to form same is reversed from that indicated in FIGS. 6, 7 and 8 to provide the left hand heel retractor 120A as a mirror image of the retractor 120 and thus of device 130 (whereby device 130A is provided). The left hand retractor 120A is applied to the left hand support 50A and its heel strap 80 in the same manner as described with respect to the retractor 120.

With the foot rest assemblies 40 and 42 both equipped with the respective retractors 120 and 120A, when the patient is to enter or leave the chair, the foot rest members 60 and 60A are swung upwardly, from their extended positions of FIGS. 1 and 2 to the upwardly directed retracted position illustrated by the showing of FIG. 3. As the foot rest members 60 and 60A move from their extended to their retracted positions, the retractors 120 and 120A remain stationary, as the supports 50 and 50A remain stationary during this movement. The foot rest members 60 and 60A, however, swing upwardly toward the respective upright portions 52 and 52A, and in so doing the finger 146, and specifically its camming end portion 148, is moved downwardly of the rear side of the strap 80; as the screw and nut device 100 and the strap loop 96 to which it is applied, are swung toward but forwardly of the adjacent post 52 (and thus in a plane located forwardly of the said adjacent post 52), from the position of FIG. 4 and consecutively through the positions of FIGS. 9 and 10 to the positions of FIGS. 3 and 12, the heel straps 80 are retracted or inverted from their heel rest catenary type shaping of FIGS. 1, 2 and 5 to the forwardly projecting relation shown in FIGS. 10 and 12, whereby the entire strap 80 is disposed forwardly of the foot rest support upright portions 52, so that the foot rest members 60 and 60A may be swung flush against the respective upright portions 52, as indicated in FIGS. 3 and 4. This retraction of the heel strap 80 is effected automatically by the swinging of the foot rest members 60 from their extended to their retracted positions, and neither the patient nor his aid, if any, need give any thought to having to reposition the heel straps to properly position the foot rest members for full free access into and out of the chair 10. The showings of FIGS. 10 and 12 are in effect side elevational views of the assembly 40 taken from the left rear side of FIG. 3, and in this position of parts, the finger camming portion 148 is disposed adjacent the lower edging 119 of strap 80, as distinguished from the position of FIG. 4.

When a patient is seated in the chair 10, and the foot rest members 60 and 60A are returned to their operative positions of FIGS. 1, 2 and 5, the finger 146 of the respective devices 120 and 120A returns to the relative position shown in FIGS. 4 and 5. This may leave the heel strap 80 in its forward directed relation, but when the patient's feet are applied to the foot rest member 60, either by himself or, with assistance as needed, the proper comfortable positioning of the patient's feet in engagement with the respective support members 60 will seat the patient's heels against the respective heel straps 80 and return them to their heel rest shaping that is indicated in FIGS. 1, 2 and 5.

In one form of the retractor that is adapted for application to folding wheel chairs of the type offered by the aforementioned Everest & Jennings Inc. firm, the retractors are formed from stainless steel wire of the type of the diameter indicated with the socket portion being wound about axis 136 to define an internal diameter of approximately 13/16ths of an inch, with the socket portion 134 being of coil shaping having the turn spaced approximately 3/16ths of an inch longitudinally of the axis 136. The open loop 140 is struck about axis 145 that is substantially perpendicular to axis 136 and has an arcing on the radius of approximately 7/16ths inch. Finger 146 has a length of approximately 1 and 11/16ths inch from the inside diameter of the socket portion 134 in the plane that is common to axis 136 and the camming end portion 148 is struck downwardly about an arc on a radius of approximately ¾ths of and inch, to dispose the lower portion of the closed loop defined by the finger terminus 150 approximately ⅝ths of an inch below the upper level of the finger 146.

It will therefore be seen that the invention provides a simple heel retractor for wheel chair foot rest assemblies that is of one piece construction, that requires no modification of existing foot rest assembly structures, and that is applied without requiring any type of separate fasteners, drilling of holes, etc. The application of the retractor to complete the foot rest assembly that is provided by the invention involves a simple slip on snap fit application of the retractor to the foot rest support, and a finger action type wind up pulling and lifting application on the retractor finger to set in biased operation against the rear side 121 of the heel strap.

Thereafter the retractor works automatically to reverse or invert the heel from its normal heel receiving position to its out of the way position as illustrated in FIGS. 5, 9 and 10 for achieving full retraction of the foot rest assemblies, free of operational problems caused by patient inability or failure to manually reverse the heel straps in question. On return of the foot rest assemblies to their extended positions, normal positioning of the patient's feet on the foot rest members achieves the desired heel receiving catenary type shaping of the assembly heel straps.

The metal components of chair 10 are typically formed from chrome plated steel, but of course other metal and/or plastic materials of adequate strength, etc. may be employed. Frame 12 is typically equipped with fabrics and cushioning as needed to define the chair seat and back, all arranged in any conventional manner.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a wheel chair foot rest assembly for securement to a wheel chair frame, with the assembly including a right angle shaped support member having an upright portion, adapted for pendant connection to the wheel chair frame adjacent the upper end of said portion, and a forwardly projecting arm adjacent the lower end of said upright portion in substantially normal relation thereto, a foot rest member journalled on said support member for swinging movement about said arm between an extended foot rest position to one side of said arm in which said foot rest member extends substantially normally of said support upright portion and defines an upper foot rest surfacing, and a retracted position in which said foot rest member is disposed along side said support upright portion in substantially parallel relation to said support upright portion, and a flexible heel strap extending across the rear of the foot rest member and having its ends anchored thereto forwardly of said support upright portion in substantially normal relation thereto to dispose the length of said heel between its said end along said foot rest surfacing for receiving in substantial catenary fashion the heel of a patient's foot resting in the foot rest member surfacing when the latter is in its extended position, with one of the strap ends being disposed adjacent said support upright portion, the improvement comprising a retractor for said heel strap for disposing said length of the strap forwardly of said support upright portion on swinging of said platform from said extended position to said retracted position, said retraction comprising:

a resiliently flexible spring filament device including:

a helically contoured spring wind up socket portion received about said support upright portion, a lower open loop portion connected to said socket portion and being in snap fit relation to said support arm, and an upper finger connected in spring wind up relation to said socket portion and having a projecting camming end received against the rear side of said strap in sliding relation thereto adjacent said one end thereof in spring wind up relation of said socket portion for spring biasing said arm against said strap, whereby on movement of said foot rest member from said extended position to said retracted position, said heel strap length in moving with said foot rest member is cammed by said finger to be disposed forwardly of said support upright portion.

2. The improvement set forth in claim 1 wherein:

said spring filament device is of one piece construction.

3. The improvement set forth in claim 1 wherein:

said filament device socket portion, lower loop portion, and upper finger are of continuous one piece continuous spring wire construction.

4. The improvement set forth in claim 3 wherein:

said socket portion comprises a coil of said wire construction defining a central helix axis of said socket portion extending longitudinally thereof, said open loop portion being disposed in a plane paralleling said axis.

5. The improvement set forth in claim 4 wherein:

said upper finger extends normally of said axis and substantially radially of said coil, with said camming end portion comprising said finger having a terminus of closed loop configuration that is substantially coplanar with said finger.

* * * * *